US008794983B2

(12) United States Patent
Liu

(10) Patent No.: US 8,794,983 B2
(45) Date of Patent: Aug. 5, 2014

(54) ELECTRICAL CONNECTOR HAVING LOW PROFILE CHARACTERISTICS

(71) Applicant: Santa Electronics Inc., Taipei (TW)

(72) Inventor: Hsien-Chun Liu, Taipei (TW)

(73) Assignee: Santa Electronics Inc., Taipei (TW)

( * ) Notice: Subject to any disclaimer, the term of this patent is extended or adjusted under 35 U.S.C. 154(b) by 142 days.

(21) Appl. No.: 13/645,377

(22) Filed: Oct. 4, 2012

(65) Prior Publication Data

US 2013/0109225 A1 May 2, 2013

(30) Foreign Application Priority Data

Oct. 27, 2011 (TW) ..... 100139143 A

(51) Int. Cl.
*H01R 13/44* (2006.01)

(52) U.S. Cl.
USPC ..... 439/131; 439/499; 439/607.54

(58) Field of Classification Search
USPC ..... 439/131, 497, 499, 676, 607.41, 607.54
IPC ..... H01R 13/506,13/658, 13/60, 13/648, H01R 23/662, 23/02
See application file for complete search history.

(56) References Cited

U.S. PATENT DOCUMENTS

| | | | | |
|---|---|---|---|---|
| 6,638,090 | B2 * | 10/2003 | Wakata | 439/271 |
| 7,001,192 | B1 * | 2/2006 | Yeh | 439/131 |
| 7,661,990 | B1 * | 2/2010 | Chiang | 439/607.35 |
| 7,766,677 | B2 * | 8/2010 | Chiang | 439/140 |

* cited by examiner

*Primary Examiner* — Hien Vu
(74) *Attorney, Agent, or Firm* — Muncy, Geissler, Olds & Lowe, P.C.

(57) ABSTRACT

An electrical connector includes an outer housing having two side arms extended from two opposite lateral sides of a holder base thereof and defining with the holder base a sliding space, a movable inner housing movable in and out of the sliding space and having two upright sidewalls at two opposite lateral sides of a bottom panel thereof and defining with the bottom panel a mating space, mating contact pins mounted at the bottom panel of the movable inner housing and partially suspending in the mating space, and a flexible connection interface electrically connected with the mating contact pins and extending out of the movable inner housing and the outer housing for connection to an external transmission interface.

7 Claims, 12 Drawing Sheets

ELECTRICAL CONNECTOR HAVING LOW PROFILE CHARACTERISTICS

This application claims the priority benefit of Taiwan patent application number 100139143, filed on Oct. 27, 2011.

BACKGROUND OF THE INVENTION

1. Field of the Invention

The present invention relates to electrical connector technology and more particularly, to a low-profile electrical connector, which comprises an outer housing, a movable inner housing movable in and out of a sliding space of the outer housing, mating contact pins mounted inside the movable inner housing, and a flexible connection interface electrically connected with the mating contact pins and extending out of the movable inner housing and the outer housing for connection to an external transmission interface.

2. Description of the Related Art

Following fast development of computer technology, notebook computers, tablet computers and many other high mobility electronic apparatus are well developed and widely used by people for different applications. Further, with the fast and vigorous development of the internet and web services, people can connect an electronic apparatus to the internet for information searching, real time communication or playing online games.

Further, it is the market trend to create notebook computer, tablet computer and mobility electronic apparatus having light, thin, short and small characteristics. In consequence, circuit board electronic components must be made extremely strong, small and precise. Further, many different electrical connectors may be used in an electronic apparatus to connect different components and parts to a circuit board. An electrical connector for installation in a circuit board for the connection of a network connector has multiple contact pins mounted therein for bonding to respective electric contacts at a circuit board for transmitting network signal through the circuit board to a control circuit.

Further, different electrical plug connectors or modular plugs are created for use in small-sized electronic apparatus for different applications. For example, an RJ-45 modular plug is a connector standard for telephone cables or for computer network (Ethernet) cables; a four- or six-wire RJ-11 connector used primarily to connect telephone equipment. RJ-11 connectors are also used to connect some types of local-area networks (LANs), although RJ-45 connectors are more common. An RJ series connector has a standard specification and a certain dimension. However, the thickness design of modern notebook computer or tablet computer must be smaller than a conventional RJ series connector. In order to maintain a low profile, clamshell type connectors are created. A clamshell type connector comprises a base member, a cover member pivotally connected to the base member and defining with the base member an insertion space, and a plurality of contact pins mounted inside the insertion space. During application, the cover shell is turned outwardly relative to the base member to a tilted open position for allowing insertion of an external mating network plug connector into the insertion space. However, when opening the cover shell, the pivot pins of the cover shell may be accidentally forced out of respective pivot holes at the base member, causing separation between the base member and the cover shell. When the clamshell type connector is in the close position, it exhibits a low profile. However, when the cover shell is opened and kept in the tilted open position, the clamshell type connector occupies a relatively greater vertical space. Therefore, it is desirable to provide an electrical connector, which constantly maintains a low profile either in a close position or open position.

SUMMARY OF THE INVENTION

The present invention has been accomplished under the circumstances in view. It is therefore the main object of the present invention to provide an electrical connector, which has low profile characteristics and ensures signal transmission stability and reliability and provides fool-proof protection.

To achieve this and other objects of the present invention, an electrical connector comprises an electrically insulative outer housing having a holder base, two side arms extended from two opposite lateral sides of the holder base and a sliding space surrounded by the holder base and the side arms, an electrically insulative movable inner housing movable in and out of the sliding space of the electrically insulative outer housing and having a bottom panel, two upright sidewalls at two opposite lateral sides of the bottom panel thereof and defining a mating space surrounded by the bottom panel and the two upright sidewalls, mating contact pins mounted at the bottom panel of the movable inner housing and partially suspending in the mating space, and a flexible connection interface electrically connected with the mating contact pins and extending out of the movable inner housing and the outer housing for connection to an external transmission interface.

Further, the electrically insulative outer housing further comprises two sliding ways respectively longitudinally located on the side arms; the electrically insulative movable inner housing further comprises two slide blocks respectively located on the two upright sidewalls and respectively slidably coupled to the two sliding ways of the electrically insulative outer housing to guide sliding movement of the electrically insulative movable inner housing in and out of the electrically insulative outer housing smoothly and steadily facilitating accurate installation of an external RJ-45 modular plug of an external flexible connection interface. Subject to the slidable coupling arrangement between the electrically insulative outer housing and the electrically insulative movable inner housing, the electrical connector has low profile characteristics.

Further, the electrically insulative outer housing further comprises an endless sliding groove longitudinally located on an inner side of one side arm and defining a rear positioning end portion; the electrically insulative movable inner housing further comprises a wire guide rod that has its one end fastened to one upright side panel of the electrically insulative movable inner housing and its other end coupled to the endless sliding groove of the electrically insulative outer housing for guiding the electrically insulative movable inner housing to move in and out of the sliding space of the electrically insulative outer housing between a close position and an open position.

DETAILED DESCRIPTION OF THE PREFERRED EMBODIMENT

Figure 1:
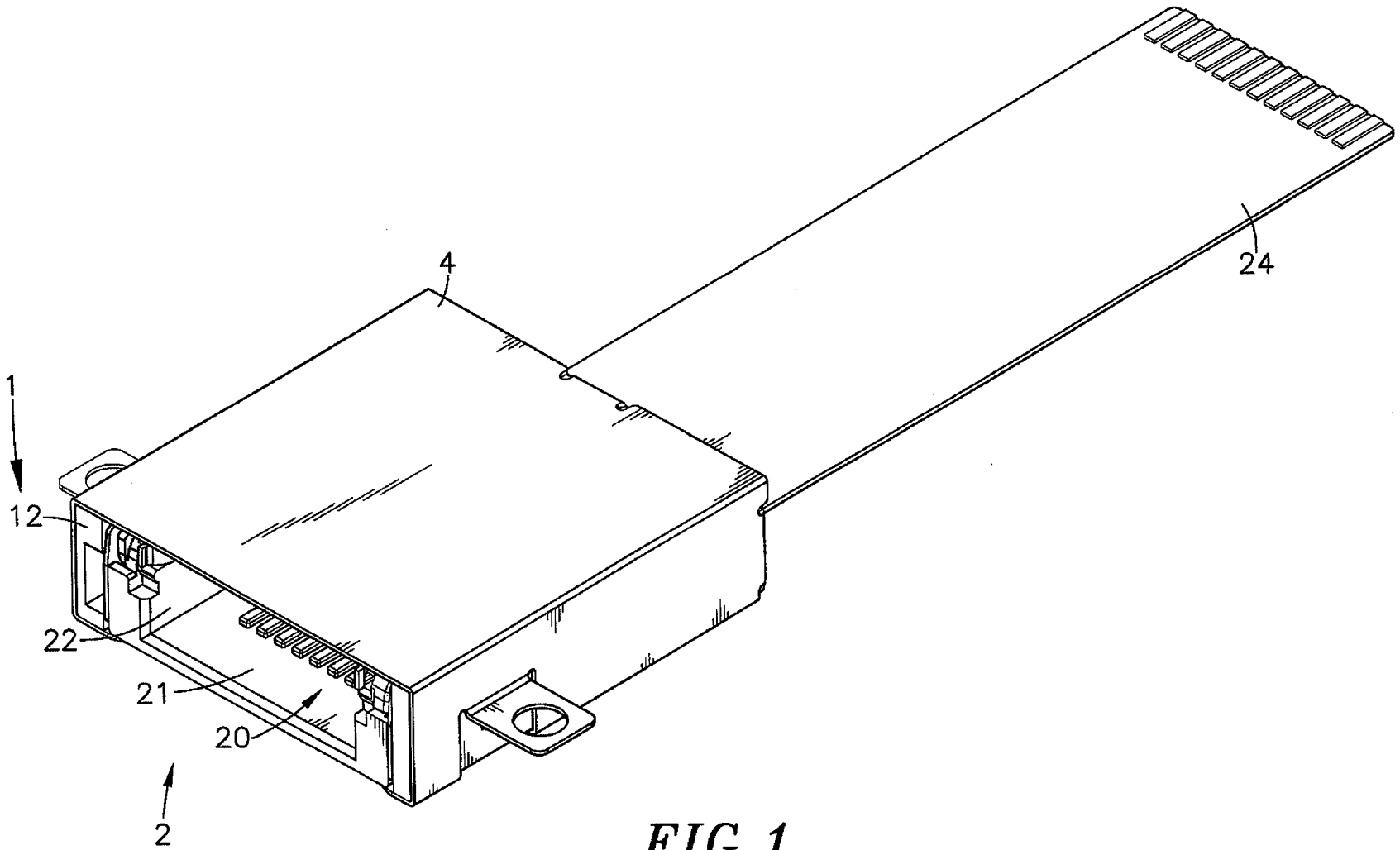
FIG. 1 is an oblique top elevational view of an electrical connector in accordance with the present invention.
Figure 2:
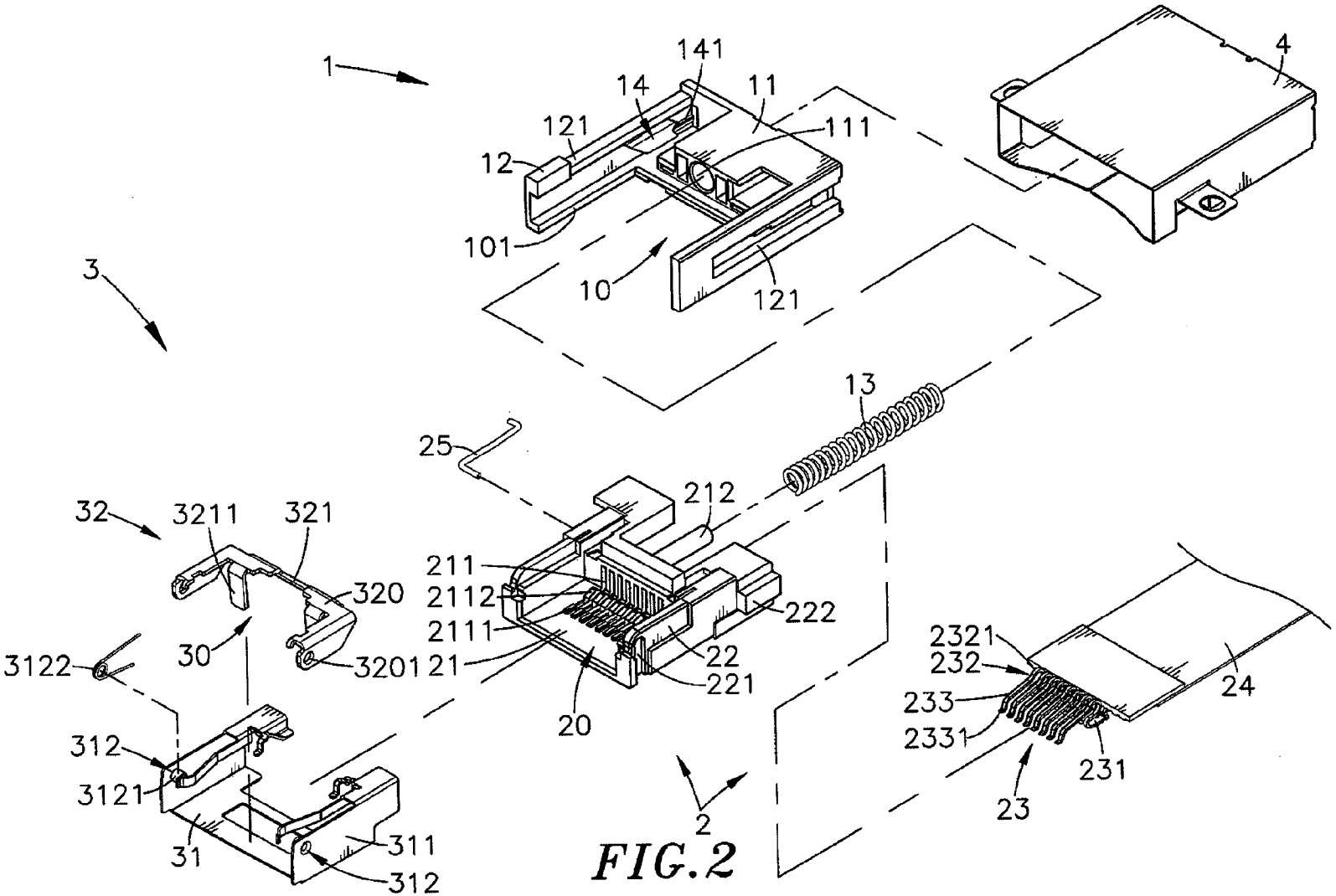
FIG. 2 is an exploded view of the electrical connector in accordance with the present invention.
Figure 3:
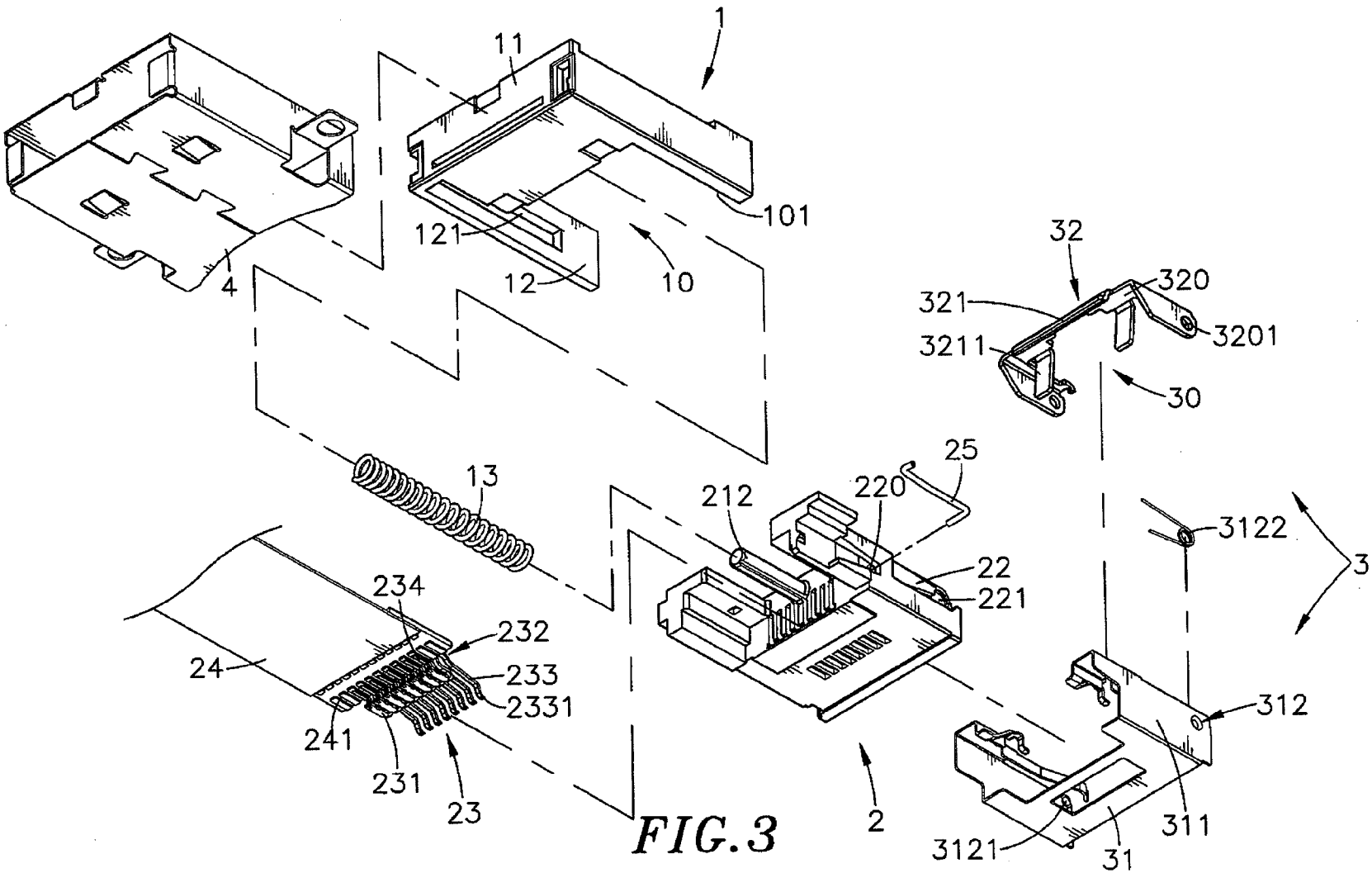
FIG. 3 corresponds to FIG. 2 when viewed from another angle.
Figure 4:
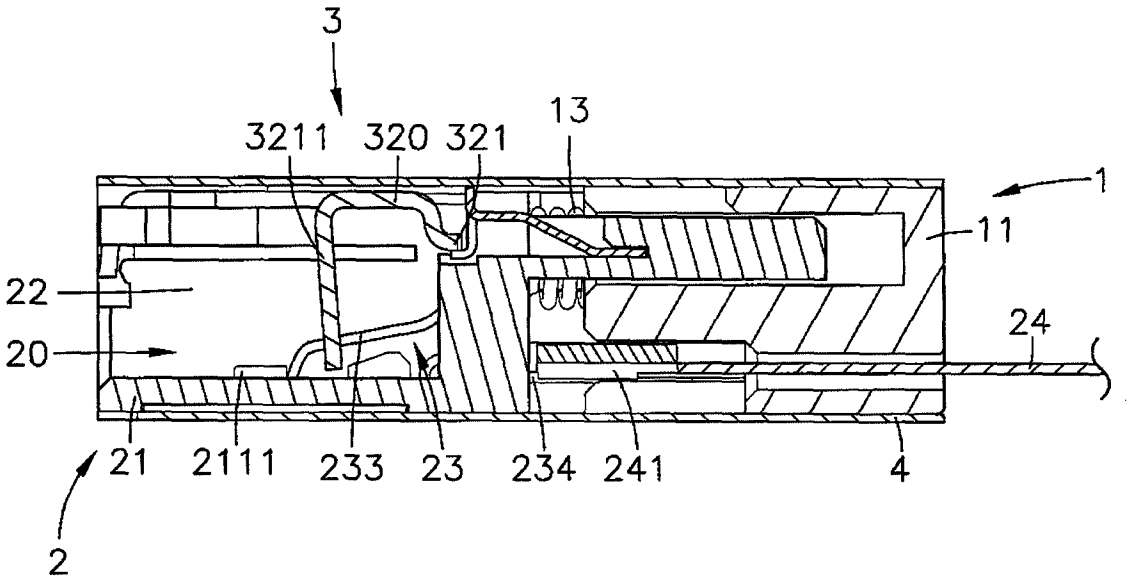
FIG. 4 is a sectional side view of the electrical connector in accordance with the present invention.

Referring to FIGS. 1, 2, 3 and 4, an electrical connector in accordance with the present invention is shown. The electrical connector comprises an electrically insulative outer housing 1, an electrically insulative movable inner housing 2, a set of mating contact pins 23, a flexible connection interface 24, a positioning mechanism 3, and a metal shield 4.

The outer housing 1 comprises a holder base 11, a recessed hole 111 located on the middle of the front side of the holder base 11, two side arms 12 extended from two opposite lateral sides of the holder base 11 in one same direction in a parallel manner, a sliding space 10 surrounded by the holder base 11 and the side arms 12 for accommodating the movable inner housing 2 and for enabling the movable inner housing 2 to be moved in and out of the outer housing 1, two sliding ways 121 respectively located on the side arms 12 and extending along the length of the side arms 12, and a bottom opening 101 at the bottom side of the sliding space 10.

The movable inner housing 2 comprises a bottom panel 21, a back pin 212 backwardly extended from the middle of the rear side of the bottom panel 21, two upright sidewalls 22 respectively perpendicularly extended from two opposite lateral sides of the bottom panel 21, a positioning groove 221 located on the respective front sides of the two upright sidewalls 22, two slide blocks 222 respectively located on the respective rear sides of the two upright sidewalls 22, and a mating space 20 surrounded by the bottom panel 21 and the upright sidewalls 22.

The mating contact pins 23 specially configured and mounted at the bottom panel 21 of the movable inner housing 2 and partially suspending in the mating space 20.

The flexible connection interface 24 can be a FPC (Flexible Printed Circuit) or FFC (Flexible Flat Cable) electrically connected with the mating contact pins 23 and extending out of the movable inner housing 2 and the outer housing 1.

When assembling the electrical connector, connect the flexible connection interface 24 to the mating contact pins 23 and then install the mating contact pins 23 in the bottom panel 21 of the movable inner housing 2, and then insert the movable inner housing 2 into the sliding space 10 surrounded by the holder base 11 and the side arms 12 to let the flexible connection interface 24 be extended out of the outer housing 1 through the bottom opening 101 at the bottom side of the sliding space 10. During application of the electrical connector, connect the other end of the flexible connection interface 24 to a predetermined external electrical connector, data transmission base or circuit board (not shown).

Further, the movable inner housing 2 further comprises a plurality of insertion slots 211 located on the bottom panel 21 near a rear side thereof in communication between the mating space 20 and the space outside the movable inner housing 2, and a stop block 2111 with a bevel stop face 2112 disposed at a front side of each of the insertion slots 211. Further, each mating contact pin 23 comprises a base portion 231, a contact portion 233 terminating in a positioning tip 2331 that is stopped against the bevel stop face 2112 of one stop block 2111 of the movable inner housing 2, a springy arm 232 connected between one end of the base portion 231 and the contact portion 233 and having at least one bent 2321 inserted through one insertion slot 211 of the movable inner housing 2, and a bonding portion 234 extended from an opposite end of the base portion 231 and bonded to one respective contact 241 of the flexible connection interface 24 by SMT (Surface-mount technology) or through-hole technology.

The positioning mechanism 3 comprises an outer shell 31, a swivel member 32, and two torsion springs 3122. The outer shell 31 is attached to the movable inner housing 2 to cover the bottom side of the movable inner housing 2, comprising two upright side panels 311, two locating blocks 312 respectively located on the respective front sides of the upright side panels 311, two pivot pins 3121 respectively extended from the locating blocks 312 to support the torsion springs 3122. The swivel member 32 is pivotally coupled between the locating blocks 312 of the outer shell 31, comprising a substantially U-shaped frame 320, two pivot holes 3201 respectively located on the two distal ends of the U-shaped frame 320 and respectively pivotally coupled to the pivot pins 3121 of the outer shell 31, a retaining groove 321 located on the middle of the U-shaped frame 320, and two guide rails 3211 downwardly extended from the U-shaped frame 320 at two opposite sides relative to the retaining groove 321. The torsion springs 3122 are respectively supported on the two pivot pins 3121 of the outer shell 31 and respectively stopped with the respective two opposite ends thereof against the positioning grooves 221 at the two upright side panels 22 of the movable inner housing 2 and the U-shaped frame 320 for returning the swivel member 32 after the swivel member 32 having been biased. When the positioning mechanism 3 is assembled, the outer shell 31 and the swivel member 32 define therebetween a receiving port 30.

Further, the metal shield 4 surrounds the outer housing 1 for electromagnetic interference shielding.

Figure 5:
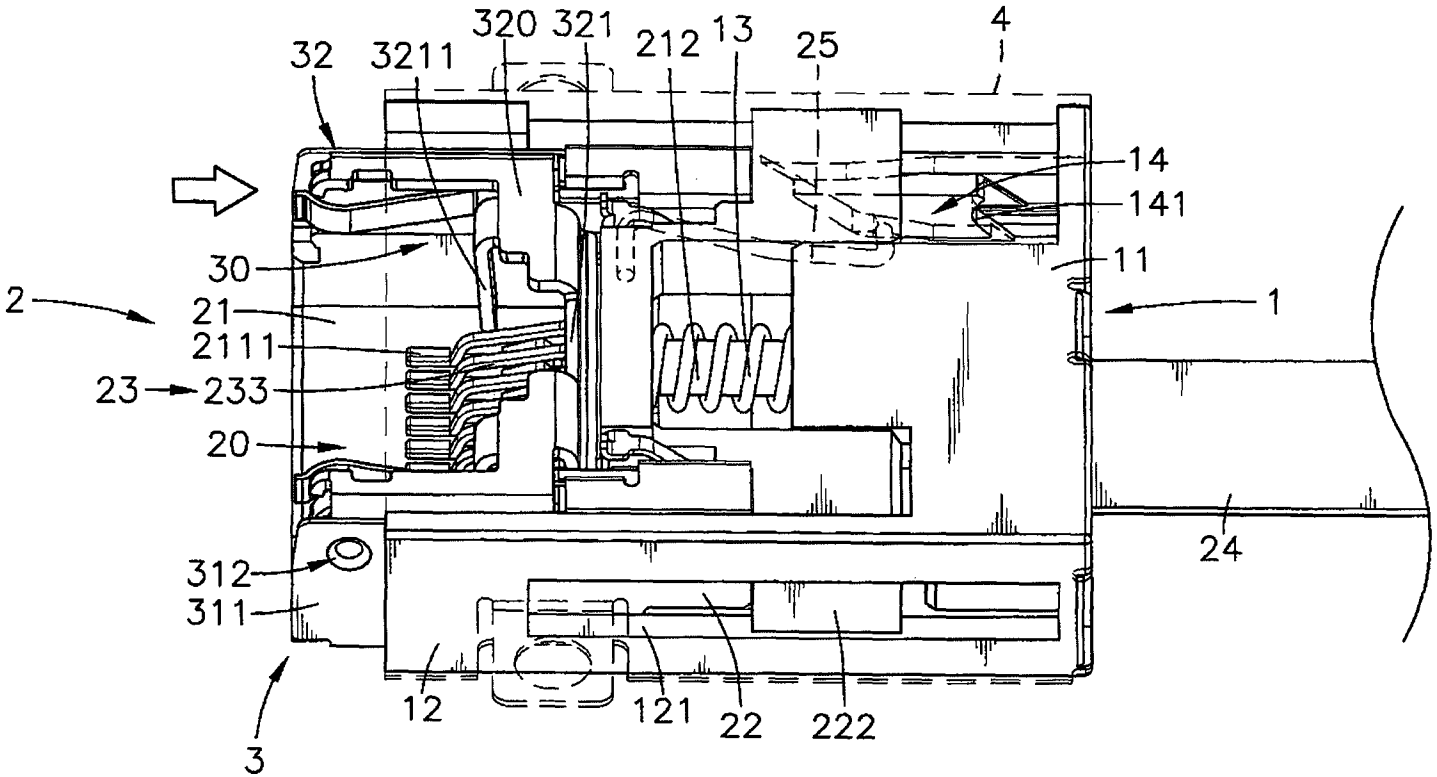
FIG. 5 is a schematic top view of the present invention, illustrating the movable inner housing moved toward the inside of the outer housing.
Figure 6:
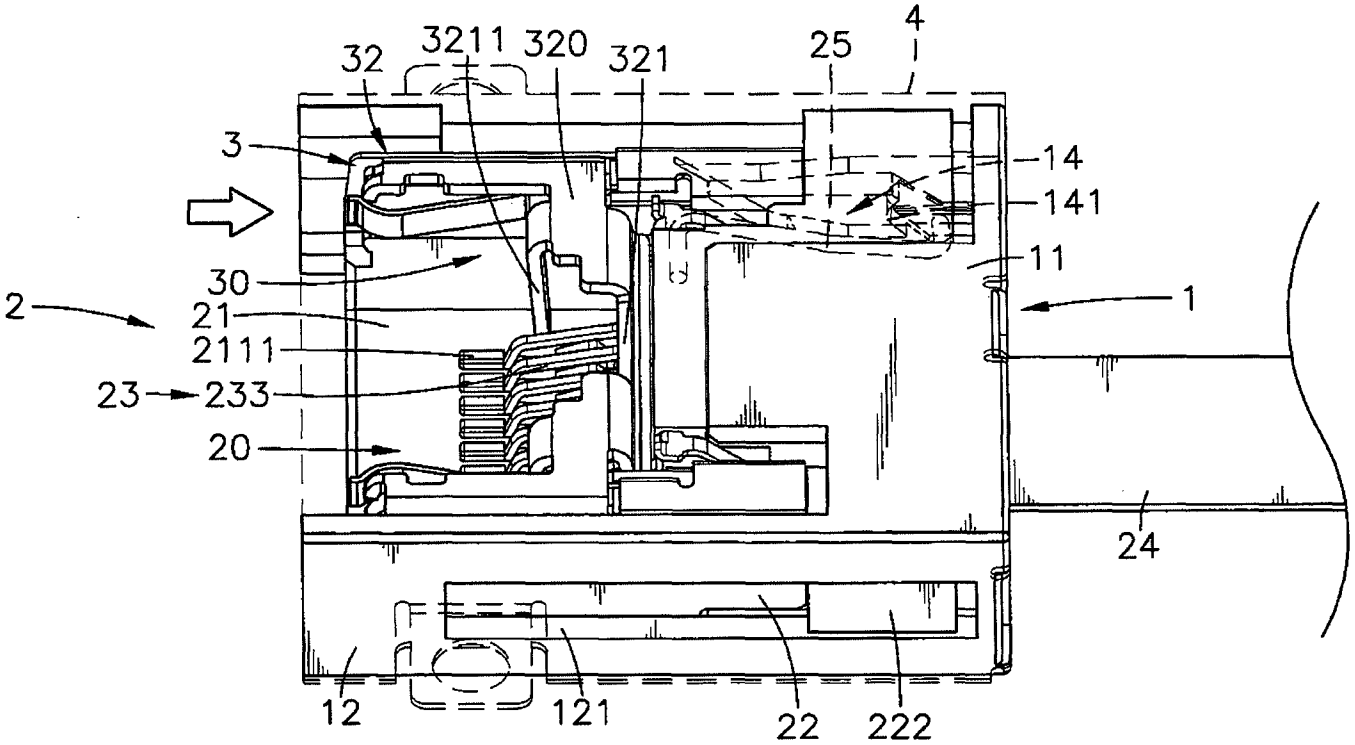
FIG. 6 is a schematic top view of the present invention, illustrating the movable inner housing received in the inside of the outer housing.
Figure 7:
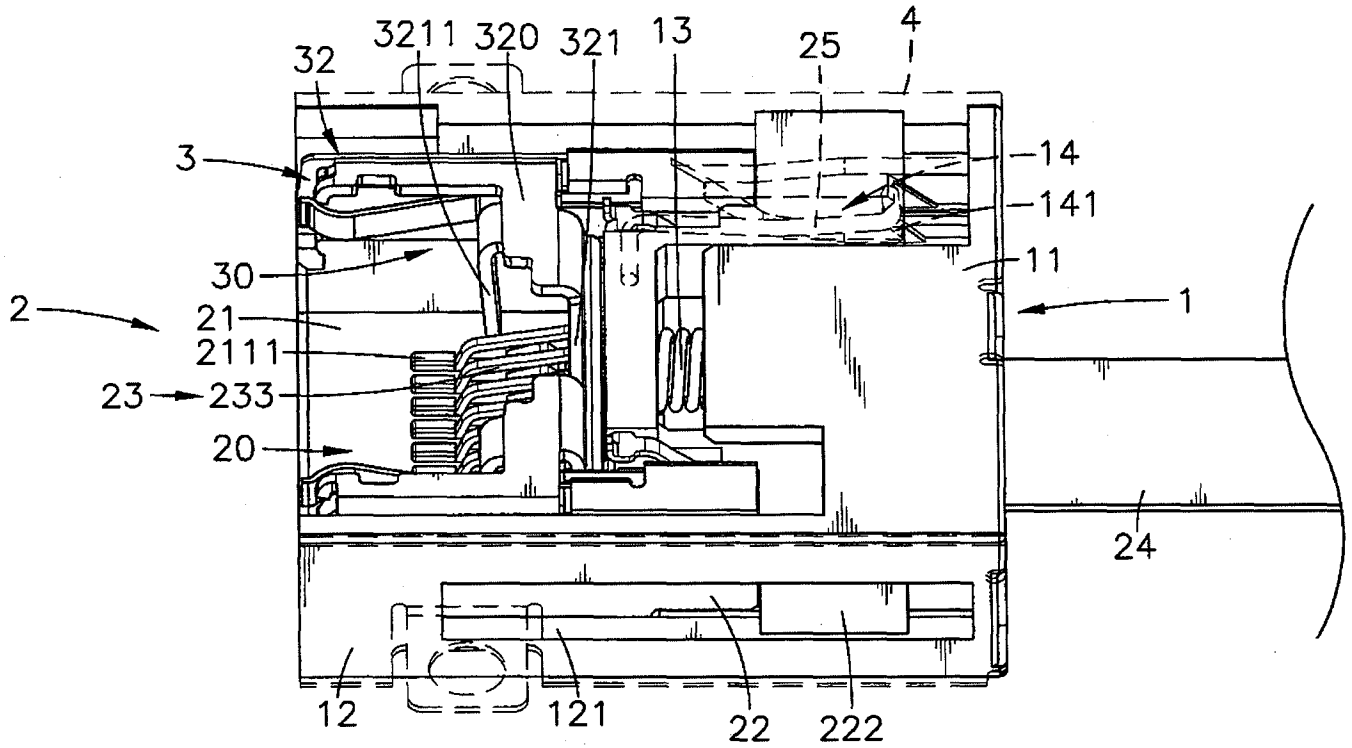
FIG. 7 is a schematic top view of the present invention, illustrating the movable inner housing positioned in the close position inside the outer housing.

Referring to FIGS. 5, 6 and 7, when using the electrical connector, insert the movable inner housing 2 into the sliding space 10 of the outer housing 1 to couple the two slide blocks 222 of the movable inner housing 2 to the two sliding ways 121 of the outer housing 12, allowing the movable inner housing 2 to be moved in and out of the sliding space 10 of the outer housing 1. When the movable inner housing 2 is received in the sliding space 10 of the outer housing 1, the electrical connector exhibits low profile characteristics.

Further, the movable inner housing 2 can be designed to be moved into the inside of the sliding space 10 of the outer housing 1 manually. However, this manual operation is not a limitation. In this embodiment, a spring member 13 is set between the outer housing 1 and the movable inner housing 2. The spring member 13 has its one end positioned in the recessed hole 111 of the holder base 11 of the outer housing 1 and its other end sleeved onto the back pin 212 at the rear side of the bottom panel 21 of the movable inner housing 2 and stopped against the bottom panel 21 of the movable inner housing 2. Further, the outer housing 1 comprises an endless sliding groove 14 longitudinally located on an inner side of one side arm 12 thereof and defining a rear positioning end portion 141; the movable inner housing 2 further comprises a wire guide rod 25, which has its one end fastened to a through hole 220 at one upright side panel 22 of the movable inner housing 2 and its other end coupled to the endless sliding groove 14 of the outer housing 1 for cycling.

During application of the present invention, press the movable inner housing 2 toward the inside of the sliding space 10 of the outer housing 1 to compress the spring member 13 and to move the wire guide rod 25 along the endless sliding groove 14 of the outer housing 1. When the wire guide rod 25 reached the rear positioning end portion 141 of the endless sliding groove 14, release the movable inner housing 2 to complete a primary press-positioning action. At this time, the movable inner housing 2 is received in a close position inside the outer housing 1. The structural design of the present invention ensures smooth movement of the movable inner housing 2 relative to the outer housing 1 without vibration.

Figure 8:
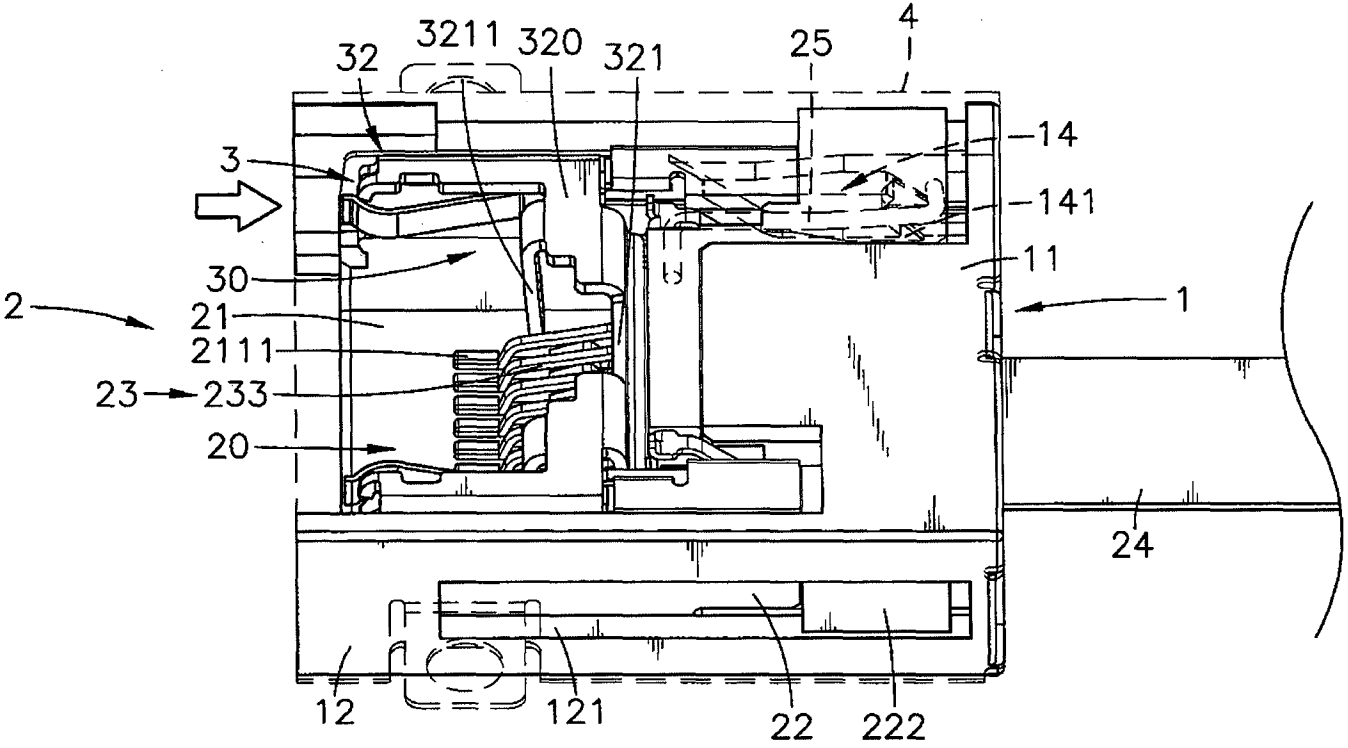
FIG. 8 is a schematic top view of the present invention, illustrating the movable inner housing pressed secondarily.
Figure 9:
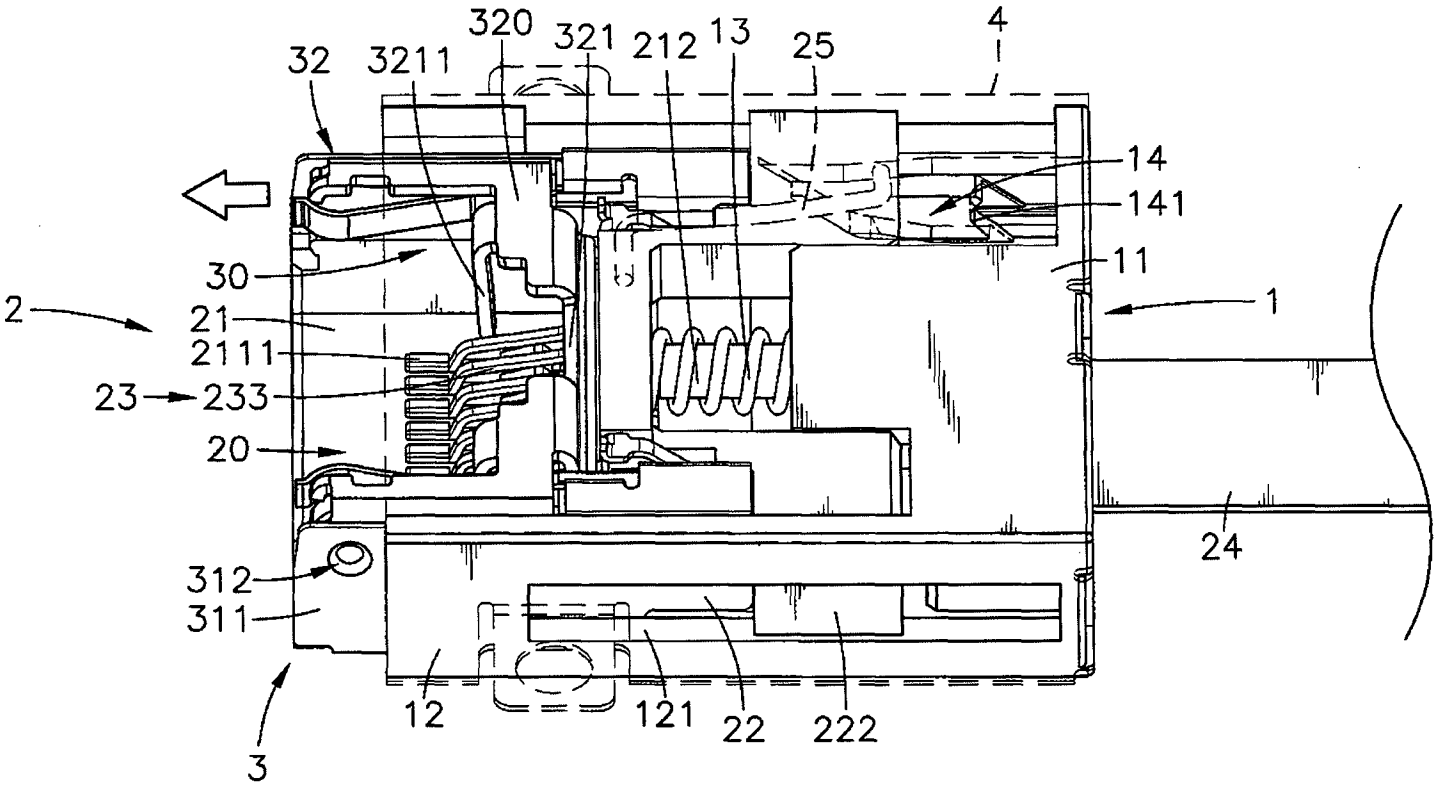
FIG. 9 is a schematic top view of the present invention, illustrating the movable inner housing moved toward the outside of the outer housing.
Figure 10:
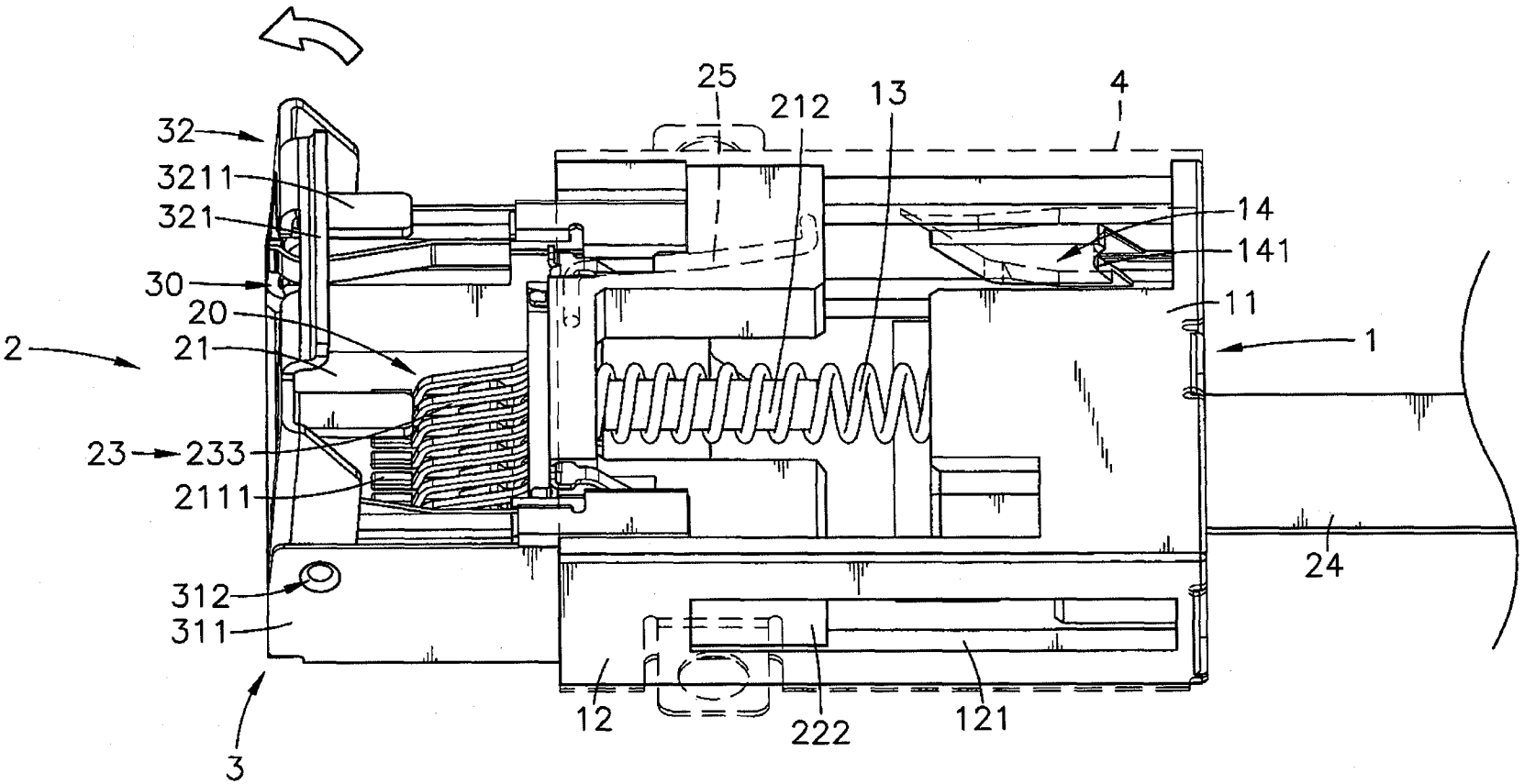
FIG. 10 is a schematic top view of the present invention, illustrating the movable inner housing moved out of the outer housing.

Referring to FIGS. 8, 9 and 10, when going to eject the movable inner housing 2 out of the sliding space 10 of the outer housing 1, press the movable inner housing 2 again to move the wire guide rod 25 away from the constraint of the rear positioning end portion 141 of the endless sliding groove 14, enabling the movable inner housing 2 to be returned to its former open position by the elastic restoring force of the spring member 13 to complete a secondary press-positioning action. Subject to the aforesaid primary and secondary press-positioning actions, the movable inner housing 2 can be accurately and smoothly moved in and out of the sliding space 10 of the outer housing 1 and positively held in the close or open position. However, it is to be understood that the aforesaid arrangement between the wire guide rod 25 and the endless sliding groove 14 for enabling the movable inner housing 2 to be accurately and smoothly moved in and out of the sliding space 10 of the outer housing 1 and positively held in the close or open position is simple an example of the present invention but not intended as a limitation, other equivalent designs or modifications may be made without departing from the spirit and scope of the invention.

Figure 11:
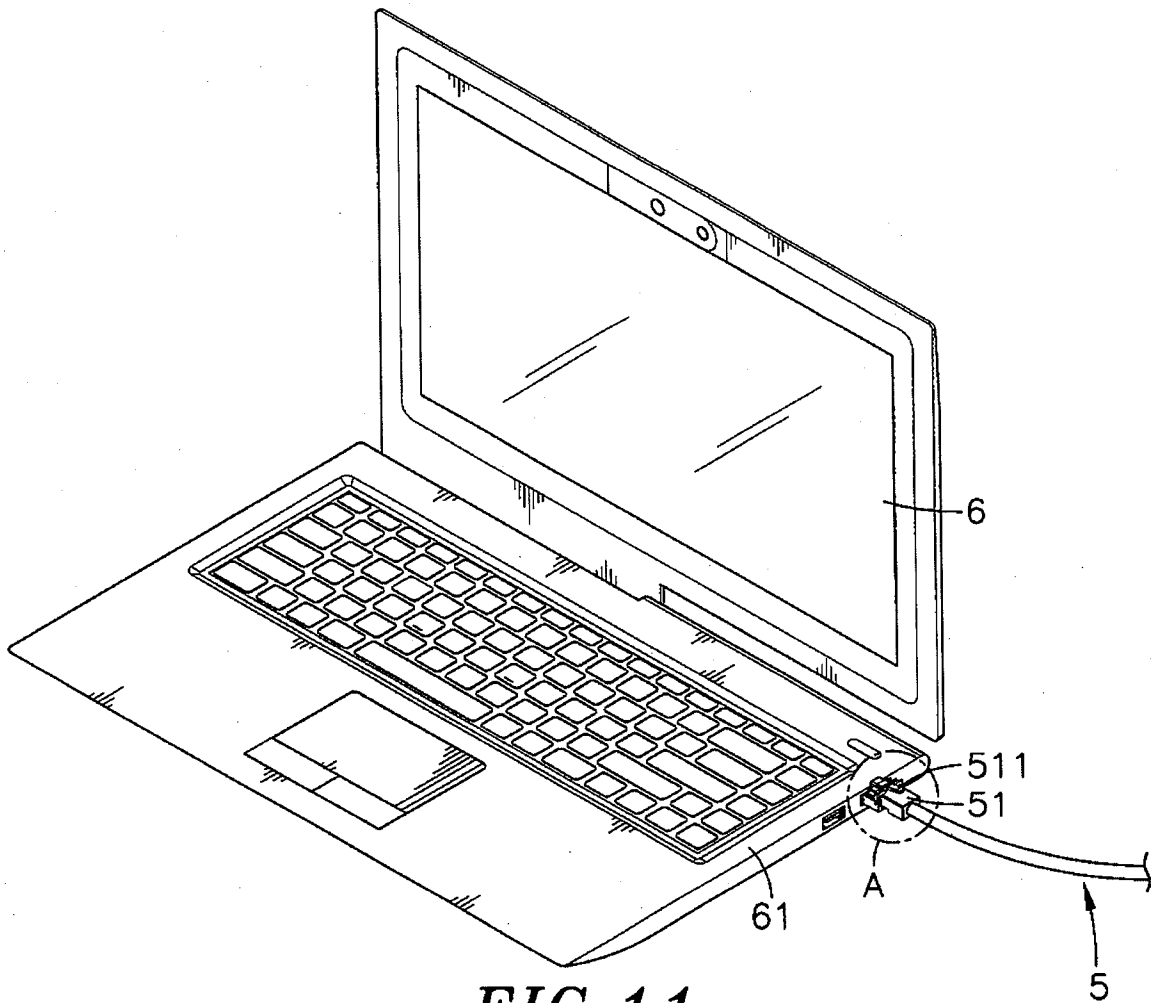
FIG. 11 is an applied view of the present invention, illustrating the electrical connector installed in a base member of a notebook computer.
Figure 12:
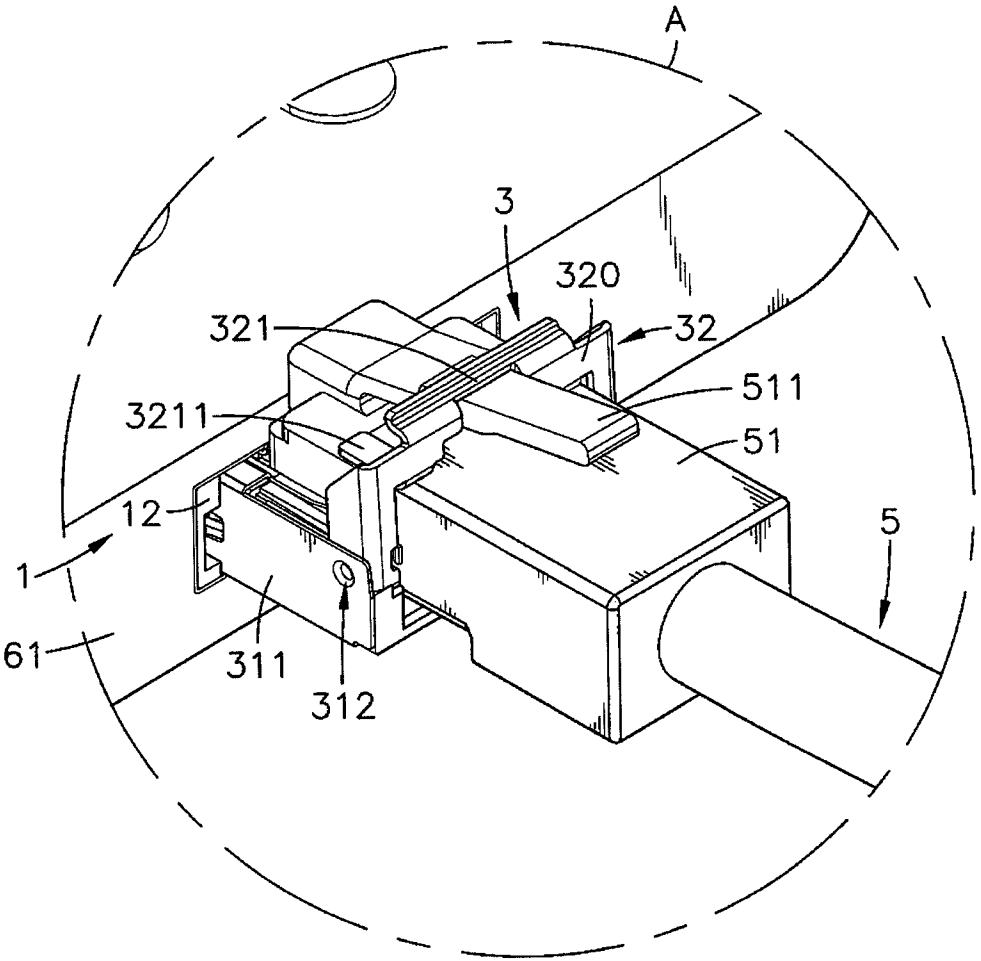
FIG. 12 is an enlarged view of Part A of FIG. 11.

Referring to FIGS. 11 and 12, the electrical connector of the present invention can be used in a desk computer, notebook computer, tablet computer, or any other electronic apparatus 6. The outer housing 1 can be an independent member detachably fastened to the base member 61 of the electronic apparatus 6. Alternatively, the outer housing 1 can be formed integrally of a part of the base member 61 of the electronic apparatus 6. After installation in the electronic apparatus 6, the mating contact pins 23 are electrically connected to the internal circuit board in the base member 61 of the electronic apparatus 6 by the flexible connection interface 24 for the transmission of network signal and power supply.

When the user pulls the movable inner housing 2 out of the sliding space 10 of the outer housing 1, or presses the movable inner housing 2 to achieve a secondary press-positioning action, the flexible connection interface 24 can be moved by the movable inner housing 2 relative to the outer housing 1 and the base member 61 of the electronic apparatus 6, avoiding an electric connection failure and assuring a high level of signal transmission stability.

Further, immediately after the movable inner housing 2 has been ejected out of the sliding space 10 of the outer housing 1, the swivel member 32 of the positioning mechanism 3 is forced by the torsion springs 3122 to turn about the respective pivot pins 3121 of the locating blocks 312 of the outer shell 31 of the positioning mechanism 3, thereby expanding the receiving port 30 between the outer shell 31 and the swivel member 32 for allowing a RJ-45 modular plug 51 of an external flexible connection interface 5 to be inserted through the receiving port 30 along the two guide rails 3211 into the mating space 20 of the movable inner housing 2. After the RJ-45 modular plug 51 of the external flexible connection interface 5 has been inserted into position in the mating space 20 of the movable inner housing 2, the RJ-45 modular plug 51 of the external flexible connection interface 5 is electrically connected to the mating contact pins 23 and the clip 511 of the RJ-45 modular plug 51 of the external flexible connection interface 5 is engaged into the retaining groove 321 of the swivel member 32, and thus the RJ-45 modular plug 51 of the external flexible connection interface 5 is electrically connected to the electronic apparatus 6 through the flexible connection interface 24 for intercommunication.

Further, the RJ-45 modular plug 51 of the external flexible connection interface 5 has a height relatively smaller than a RJ-11 modular plug. When inserting a RJ-11 modular plug into the mating space 20 of the movable inner housing 2, the RJ-11 modular plug will squeeze the contact portions 233 of the mating contact pins 23 to elastically deform the bents 2321 of the mating contact pins 23, forcing the respective contact portions 233 against the bevel stop faces 2112 of the respective stop blocks 2111, and therefore the RJ-11 modular plug will be stopped from further forward insertion, avoiding improper mating contact pin damage. Thus, the invention ensures signal transmission stability and reliability and provides fool-proof protection.

Referring to FIGS. 2, 7, 10 and 12 again, the main feature of the present invention is that: the movable inner housing 2 is movable in and out of the sliding space 10 of the outer housing 1 and the mating contact pins 23 are installed in the movable inner housing 2 and electrically connected to the flexible connection interface 24; the movable inner housing 2 can be ejected out of the sliding space 10 of the outer housing 1 through a secondary press-positioning action for allowing insertion of a RJ-45 modular plug 51 of an external flexible connection interface 5 into the mating space 20 of the movable inner housing 2 to electrically connect the mating contact pins 23.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector, comprising:

an electrically insulative outer housing comprising a holder base, two side arms extended from two opposite lateral sides of said holder base in one same direction in a parallel manner, and a sliding space surrounded by said holder base and said side arms;

an electrically insulative movable inner housing movable in and out of said sliding space of said electrically insulative outer housing, said electrically insulative movable inner housing comprising a bottom panel, two upright sidewalls respectively perpendicularly extended from two opposite lateral sides of said bottom panel, and a mating space surrounded by said bottom panel and said upright sidewalls;

a plurality of mating contact pins mounted at said bottom panel of said electrically insulative movable inner housing and partially suspending in said mating space; and a flexible connection interface electrically connected with said mating contact pins and extending out of said electrically insulative movable inner housing and said electrically insulative outer housing for connection to an external transmission interface; and wherein said electrically insulative outer housing further comprises an endless sliding groove longitudinally located on an inner side of one said side arm and defining a rear positioning end portion; said electrically insulative movable inner housing further comprises a wire guide rod, said wire guide rod having one end thereof fastened to one said upright side panel of said electrically insulative movable inner housing and an opposite end thereof coupled to said endless sliding groove of said electrically insulative outer housing for guiding said electrically insulative movable inner housing to move in and out of said sliding space of said electrically insulative outer housing between a close position and an open position.

2. The electrical connector as claimed in claim 1, wherein said electrically insulative outer housing is installed in a base member of an external electronic apparatus, defining a bottom opening at a bottom side of said sliding space for the passing of said flexible connection interface for enabling said flexible connection interface to be electrically connected to a circuit board in said base member of said external electronic apparatus.

3. The electrical connector as claimed in claim 1, wherein said electrically insulative movable inner housing further comprises a plurality of insertion slots located on said bottom panel near a rear side thereof, and a stop block disposed at a front side of each said insertion slot; each said mating contact pin comprises a base portion, a contact portion terminating in a positioning tip stopped against one said stop block of said electrically insulative movable inner housing, a springy arm connected between one end of said base portion and said contact portion, said springy arm defining at least one bent inserted through one said insertion slot of said electrically insulative movable inner housing, and a bonding portion extended from an opposite end of said base portion and bonded to one respective contact of said flexible connection interface.

4. The electrical connector as claimed in claim 1, wherein said electrically insulative movable inner housing further comprises a back pin backwardly extended from a middle part of a rear side of said bottom panel; said electrically insulative outer housing further comprises a recessed hole located on a middle part of a front side of said holder base, and a spring member positioned in said recessed hole of said holder base and sleeved onto said back pin at said bottom panel of said electrically insulative movable inner housing and stopped against said bottom panel of said electrically insulative movable inner housing.

5. The electrical connector as claimed in claim 1, wherein said electrically insulative outer housing further comprises two sliding ways respectively longitudinally located on said side arms; said electrically insulative movable inner housing further comprises two slide blocks respectively located on said two upright sidewalls and respectively slidably coupled to said two sliding ways of said electrically insulative outer housing.

6. The electrical connector as claimed in claim 1, further comprising a positioning mechanism, said positioning mechanism comprising an outer shell attached to said electrically insulative movable inner housing and covering a bottom side of said electrically insulative movable inner housing, a swivel member pivotally coupled to said outer shell and a receiving port defined between said outer shell and said swivel member, said outer shell comprising two upright side panels, two locating blocks respectively located on respective front sides of said upright side panels, two pivot pins respectively extended from said locating blocks, said swivel member being pivotally coupled between said pivot pins of said outer shell, said swivel member comprising a substantially U-shaped frame and a retaining groove located on a middle part of said U-shaped frame for securing a clip of a modular plug of an external flexible connection interface being inserted through said receiving port into said mating space.

7. The electrical connector as claimed in claim 1, wherein said flexible connection interface is selected from the group of FPC (Flexible Printed Circuit) and FFC (Flexible Flat Cable).

* * * * *